United States Patent [19]

Makihara et al.

[11] Patent Number: 4,878,865

[45] Date of Patent: Nov. 7, 1989

[54] OUTBOARD PROPULSION UNIT SUPPORTING SYSTEM FOR BOAT

[75] Inventors: Novuo Makihara; Hiroshi Ono; Norimasa Kawamura, all of Yokosuka, Japan

[73] Assignee: Nissan Motor Co., Ltd., Yokohama, Japan

[21] Appl. No.: 129,561

[22] Filed: Dec. 7, 1987

[30] Foreign Application Priority Data

Apr. 16, 1987 [JP] Japan ..... 62-57899[U]

[51] Int. Cl.[4] ..... B63H 1/28

[52] U.S. Cl. ..... 440/66; 248/642; 440/61

[58] Field of Search ..... 248/640–643; 440/61, 66

[56] References Cited

U.S. PATENT DOCUMENTS

| | | | |
|---|---|---|---|
| 2,886,462 | 5/1959 | Jagiel | 248/641 X |
| 3,075,490 | 1/1963 | Lang | 248/642 X |
| 4,449,945 | 5/1984 | Ferguson | 440/61 X |
| 4,657,513 | 4/1987 | Baker | 440/66 |
| 4,741,714 | 5/1988 | Uchida et al. | 440/66 |

FOREIGN PATENT DOCUMENTS

| | | |
|---|---|---|
| 61-12497 | 1/1986 | Japan . |
| 62-205895 | 9/1987 | Japan . |

*Primary Examiner*—Sherman D. Basinger

*Attorney, Agent, or Firm*—Foley & Lardner, Schwartz, Jeffery, Schwaab, Mack, Blumenthal & Evans

[57] ABSTRACT

A system for supporting an outboard propulsion unit to the transom of a boat. The system is comprised of a pair of transom brackets which are fixedly secured to the boat transom and positioned spaced from each other to support the outboard propulsion unit. A pair of deflector side plate sections are provided to be respectively integral with the transom brackets, and extend downwardly and rearwardly relative to the boat transom. Additionally, a deflector bottom plate section is provided to connect the lower end portions of the deflector side plate sections. The deflector bottom plate section extends rearwardly relative to the boat transom and positioned between the boat and the outboard propulsion unit. The deflector side and bottom plate sections constitute a deflector for regulating backward water flow from the boat transom, thereby preventing generation of water splash.

19 Claims, 6 Drawing Sheets

OUTBOARD PROPULSION UNIT SUPPORTING SYSTEM FOR BOAT

BACKGROUND OF THE INVENTION

1. Field of the Invention

The present invention relates to an improvement in a supporting system for supporting an outboard propulsion unit on the transom of a boat.

2. Description of the Prior Art

Hitherto a variety of supporting systems for supporting an outboard propulsion unit on a boat transom have been proposed and used in the field of boats equipped with the outboard propulsion unit. The outboard propulsion unit is usually installed slightly separate from the boat transom, and therefore rearward water flow from the boat transom impinges against the front end part of the propulsion unit immediately above a splash plate during high speed boat cruising. The thus impinging water flow is splashed upwardly and produces water spray to be sprinkled over the outboard propulsion unit and over the boat. In order to suppress such water splashing, it has been tried to form the front end part of the outboard propulsion unit into such a shape as to minimize water splashing, or to form projected portions on the opposite sides at the boat transom. However, these cannot provide sufficient splash suppressing effect.

SUMMARY OF THE INVENTION

An outboard propulsion unit supporting system of the present invention is comprised of first and second transom brackets secured to the transom of a boat and positioned spaced from each other to support an outboard propulsion unit. First and second deflector side plate sections are integral with the first and second transom brackets, respectively, and extend downwardly and rearwardly relative to the boat transom. A deflector bottom plate section is provided to connect the first and second deflector side plate sections. The deflector bottom plate section extends rearwardly relative to the boat transom and positioned between the boat and the outboard propulsion unit. The deflector side plate sections and the bottom plate section constitute a deflector for deflecting rearward water flow from the boat transom to prevent water splash.

Accordingly, during high speed cruising of the boat, the rearward water flow from the boat transom impinges against the deflector constructed of the side plate sections and the bottom plate section so as to be regulated in its flow direction to be fed as it is to the downstream side of the outboard propulsion unit. Thus, generation of water spray due to water flow impingement to the outboard propulsion unit can be effectively prevented while avoiding increasing of the number of parts because of the fact that the deflector side plate sections serve as the transom brackets.

BRIEF DESCRIPTION OF THE DRAWINGS

In the Figures, like reference numerals designate like elements and parts, in which.

DETAILED DESCRIPTION OF THE INVENTION

Figure 1:
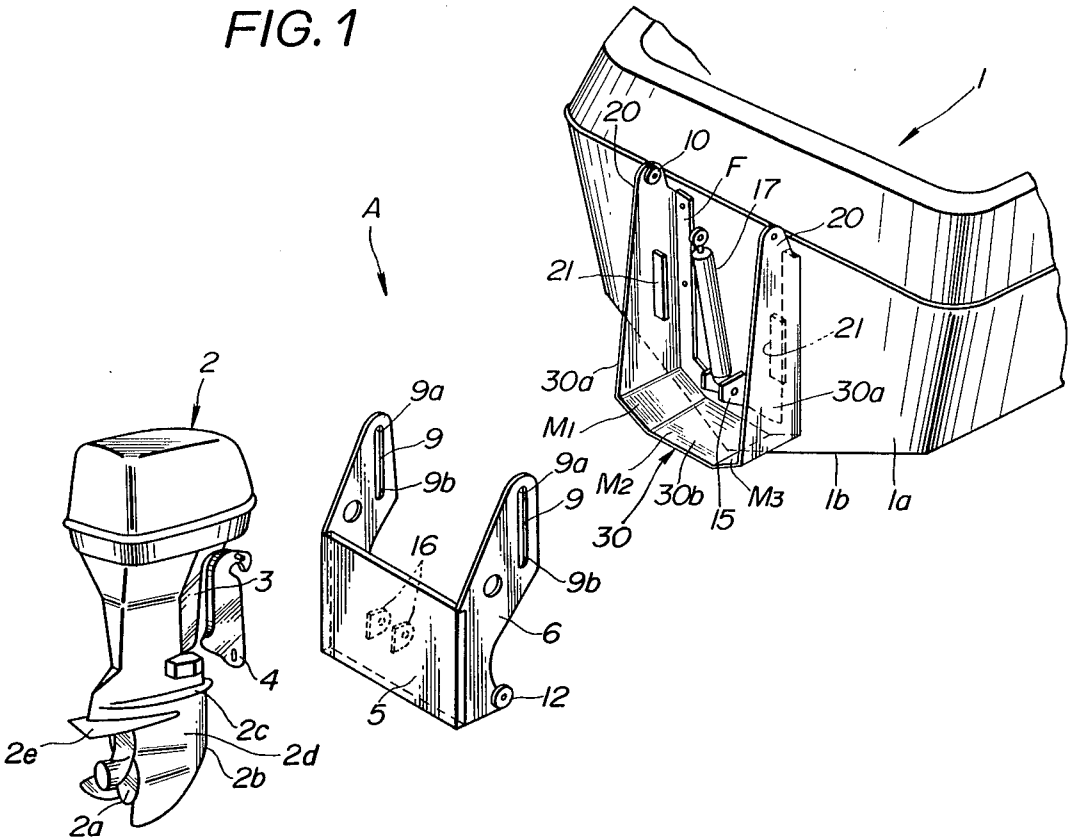
FIG. 1 is an exploded perspective view of a first embodiment of an outboard propulsion unit supporting system according to the present invention.
Figure 2:
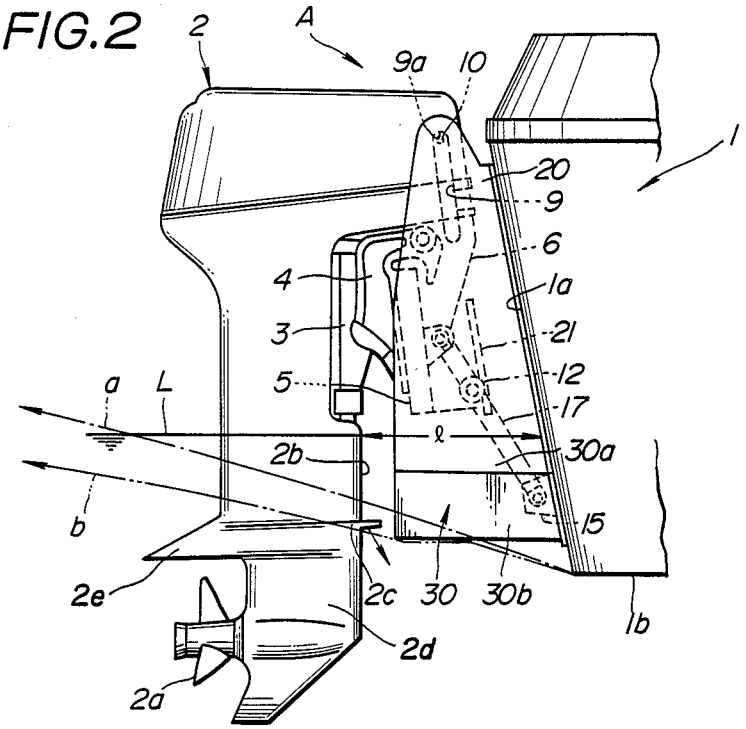
FIG. 2 is a side elevation of the supporting system of FIG. 1.

Referring now to FIGS. 1 and 2, there is shown a first embodiment of an outboard propulsion unit supporting system A by which an outboard propulsion unit 2 is supported to a boat 1. The outboard propulsion unit 2 includes a power head having an engine. The engine drives a propeller **2*a* disposed at the lower section or bottom plate 2*d* of the propulsion unit 2. The lower section of the propulsion unit 2 also serves as a rudder and formed at its upper part with a splash plate 2*c* which is projected forwardly from its front edge 2*b* and laterally from its sides thereby to suppress water flow downwardly. The lower section 2*d* of the propulsion unit 2 is provided with a cavitation plate 2*e* which is projected rearwardly and laterally therefrom to suppress cavitation in connection with the propeller 2*a*. A plate-like support bracket 5 is installed through a swivel bracket 3 and a clamp bracket 4 to the propulsion unit 2 on the side of the boat 1. A pair of vertically extending arm brackets 6, 6 are fixedly secured to the right and left side ends of the support bracket 5. Each arm bracket 6 is formed with a vertically extending slit 9 which has upper and lower terminals 9*a*, 9*b*. Each arm bracket 6 is provided at its lower section with a rotatable thrust roller 12**.

A pair of vertically extending transom brackets 20, 20 are fixedly secured to a boat transom **1*a* at the rear-most section of the boat 1. The transom brackets 20, 20 are located opposite to each other with respect to a vertical plane (not shown) containing a longitudinal axis of the boat 1, and extends rearwardly in parallel with the vertical plane. A guide roller 10 is pivotally mounted at the upper section of each transom bracket 20, and engaged within the slit 9 of the arm bracket 6. Additionally, a vertically extending guide rail 21 is provided on the inner side of each transom bracket 20 so that the thrust roller 12 engages with and rotatably movable along the guide rail 21. A pair of lower brackets 15, 15 are fixed to the boat transom 1*a* and located generally at the center between the transom brackets 20, 20. In this connection, a pair of upper brackets 16, 16 are fixedly provided on the support bracket 5 at the surface on the side of the boat 1. A tilt cylinder 17 is provided such that its lower end section is pivotally fixed to the lower brackets 15, while its upper end section is pivotally fixed to the upper brackets 16. The tilt cylinder 17 is disposed to incline obliquely and extends from the lower brackets 15, 15 to the upper brackets 16, 16. The tilt cylinder 17 is hydraulically operated to extend or contract in its length, and provided with a relief valve (not shown) which is adapted to establish fluid communication between two fluid chambers located on the opposite sides of a piston (to which a piston rod 17***a* is secured) when load over a predetermined level is applied in the direction of extension of the tilt cylinder 17.

Each transom bracket 20 extends downwardly and rearwardly to form a deflector side plate section 30*a*. The oppositely disposed deflector side plate sections 30*a*, 30*a* have the respective end edge portions which are connected by a deflector bottom plate section 30*b* which extends rearwardly from the boat transom 1*a*. The deflector bottom plate section 30*b* is integral with the side plate section 30*a*, 30*a* thereby to constitute a deflector 30.

The deflector 30 is constructed of the two deflector side plate sections 30*a*, 30*a*, and the deflector bottom plate section 30*b*. Each side plate section 30*a* extends vertically and rearwardly from the boat transom 1*a* and is parallel with the vertical plane containing the longitudinal axis of the boat 1. The two side plate sections 30*a*, 30*a* are opposite to each other with respect to the vertical plane. The upper end portion of each side plate section 30*a* reaches the upper-most part of the boat transom 1*a*, while the lower end portion of the same is located near the lower-most part of the boat transom 1*a*. The detector bottom plate section 30*b* consists of first and second side inclined plates $M_1$, $M_3$ and a flat intermediate plate $M_2$. The upper end portions of the first and second side inclined plates $M_1$, $M_3$ are integral with the lower end portions of the deflector side plate sections 30*a*, 30*a*, respectively. The intermediate plate $M_2$ is integral at its opposite end portions with the lower end portions of the first and second side inclined plates $M_1$, $M_3$. The intermediate plate $M_2$ is generally perpendicular to the vertical plane containing the boat longitudinal axis. Additionally, the side plate sections 30*a*, 30*b*, and the bottom plate section 30*b* are integrally formed with flanges F, respectively, which are integral with each other and fixed to the boat transom 1*a*. Thus, the deflector 30 is securely installed to the boat transom 1*a* without forming any slit or opening between the deflector 30 and the boat transom 1*a*.

Figure 3:
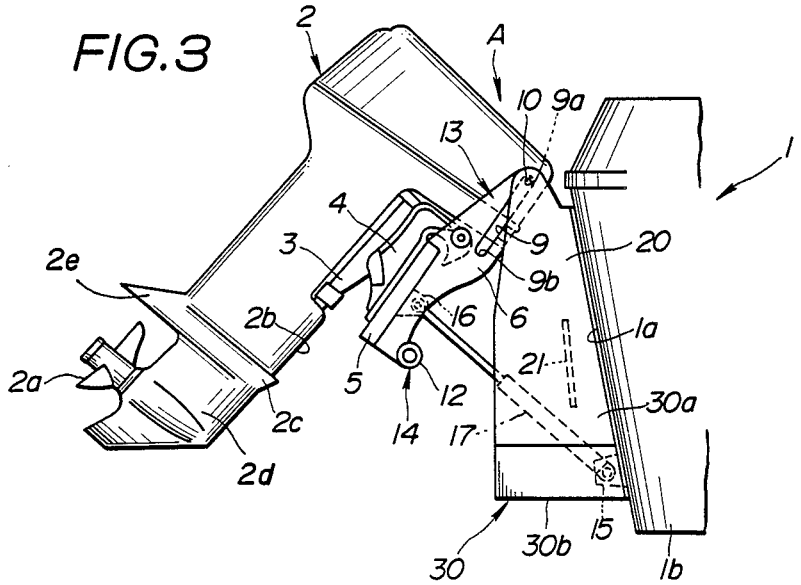
FIG. 3 is a side view similar to FIG. 2 but showing a state in which an outboard propulsion unit is kicked up.

The manner of operation of the thus configurated outboard propulsion unit supporting system will be discussed hereinafter also with reference to FIGS. 3 to 5.

The outboard propulsion unit 2 moves upward or downward together with the arm brackets 6, 6 in accordance with the extension or contraction of the tilt cylinder 17. During stopping of the boat 1, each guide roller 10 is engaged at the upper terminal 9*a* of the slit 9 of the arm bracket 6 as shown in FIG. 2.

During forward cruising of the boat 1, each thrust roller 12 is in contact with the corresponding guide rail 21 thereby to prevent the propulsion unit 2 from rotation in counterclockwise direction. During backward cruising of the boat 1, the propulsion unit 2 is prevented from rotation in clockwise direction under the restraining force of the tilt cylinder 17.

At so-called kickup of the propulsion unit 2, i.e., when the propulsion unit is kicked up by a driftwood or the like striking against it during forward cruising, the relief valve of the tilt cylinder 17 is opened since the load over the predetermined level is applied to the tilt cylinder 17 in the direction of extension. Accordingly, along with the extension of the tilt cylinder 17, the propulsion unit 2 rotates clockwise around the guide rollers 10, 10 which are engaged at the upper terminals 9*a*, 9*a* of the arm bracket slits 9, 9 as shown in FIG. 3.

Figure 4:
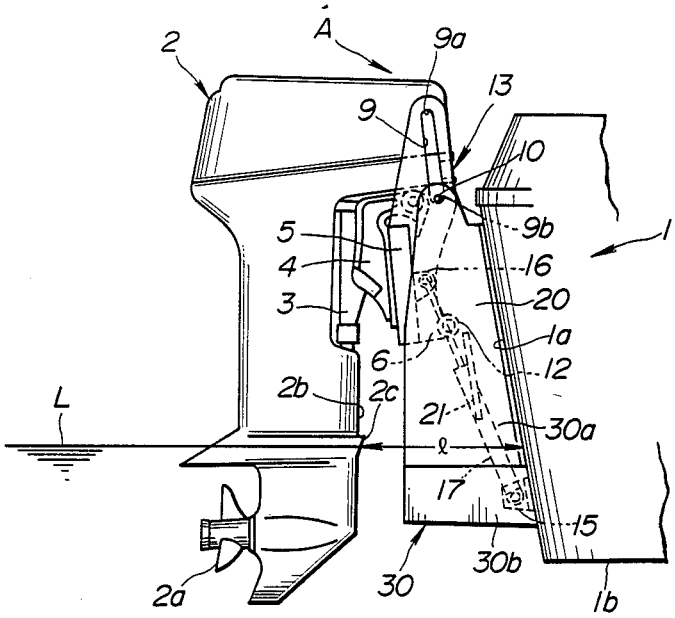
FIG. 4 is a side elevation similar to FIG. 2 but showing another state in which a boat equipped with the propulsion unit cruises on shoal.
Figure 5:
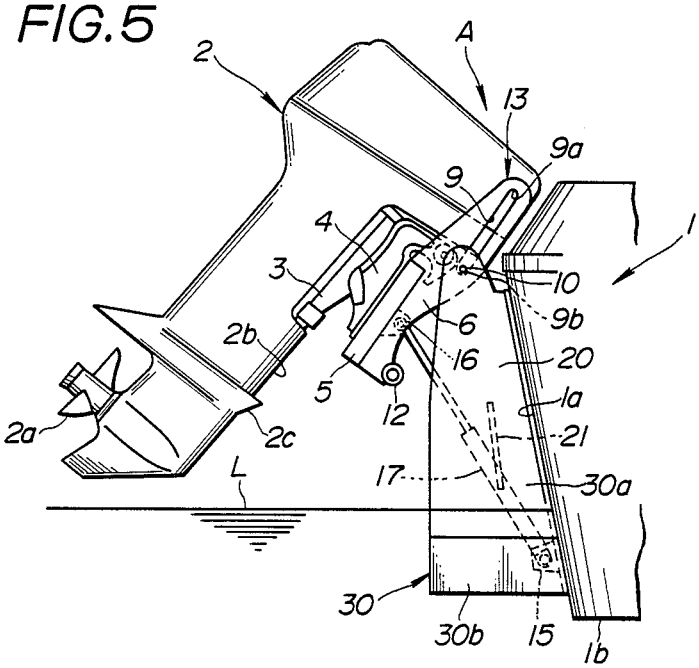
FIG. 5 is a side elevation similar to FIG. 2 but showing a further state in which the propulsion unit is tilted up.

During cruising on shoal, the propulsion unit 2 is raised until each guide roller 10 is brought into engagement with the lower terminal 9*b* of the corresponding arm bracket slit 9 under the action of the tilt cylinder 17 as shown in FIG. 4. Even in this case, the distance between the boat transom 1*a* and the propulsion unit 2 on the level L of the surface of the water is maintained equal to that in the case of FIG. 2, because the propulsion unit 2 moves vertically in connection with the fact that the slits 9 and the guide rails 21 are directed generally vertically.

In order to tilt up the propulsion unit 2, the tilt cylinder 17 is further extended over the state shown in FIG. 4. Accordingly, the propulsion unit 2 is rotated clockwise around the guide rollers 10, 10 engaged with the lower terminals 9*b*, 9*b* of the arm brackets 6, 6, so that the propulsion unit 2 is raised as shown in FIG. 5.

Next, the function of the deflector 30 during the above-mentioned forward cruising will be discussed.

As shown in FIG. 2, during high speed boat cruising, rearward waterflow from the boat bottom 1*b*and the bottom part of the boat transom 1*a* seems to strike against the front edge 2*b* immediately above the splash plate 2*c* as indicated by a dot-dash line a. However, this rearward water flow actually strikes against the deflector 30 and regulated in flow direction as indicated by a dot-dot-dash line b under flow deflection effect of the deflector 30, so that the water flow moves to the backside of the propulsion unit 2. This effectively suppresses generation of water spray due to striking of the rearward water flow against the propulsion unit lower section front edge 2*b*. The same effect is obtained even during cruising on shoal.

Thus, the following advantageous effects can be obtained by the first embodiment propulsion unit supporting system:

(1) Water spray to be generated due to striking of the rearward water flow against the front edge 2*b* of the propulsion unit 2 is effectively removed under the effect of the deflector 30 including the side plate sections 30*a* and the, bottom plate section 30*b*.

(2) Since the deflector 30 is formed integral with the transom brackets 20, the number of parts is prevented from increasing while lowering installation cost of the deflector 30.

(3) Since the deflector 30 is installed in such a manner to surround the tilt cylinder 17, floating matters such as driftwood and trash are prevented from coming to the boat transom 1*a* along the outer surface of the boat rear section. This prevents the floating matters from being put between the transom 1*a* and the tilt cylinder 17, and/or protects the tilt cylinder 17 from being struck by the floating matters. Consequently, the tilt cylinder 17 and installation section therefor are protected from damage and breakage. It will be understood that if any matter is put between the tilt cylinder 17 and the boat transom 1*a*, the inclination of the tilt cylinder 17 is unavoidably locked at a certain angle, thereby obstructing necessary operations of the tilt cylinder during propulsion unit kick-up, boat cruising on shoal and propulsion unit tilt-up.

(4) Since the lower section of the arm brackets 6 is always inside the transom brackets 20 and deflector side plate sections 30*a* in normal state as shown in FIG. 2, lateral force of the propulsion unit 2 generated by turning or the like of the propulsion unit 2 is received by the transom brackets 20 and the like, thereby stabilizing the propulsion unit 2 as compared with in case where such lateral force is received only by the thrust rollers 12.

(5) The deflector bottom plate section 30*b* is formed flat and smooth at its lower-most surface, and therefore linear water flow to impinge against the propulsion unit is not generated by the lower-most part of the deflector 30, while preventing production of a wave reaching the propeller 2*a* even during turning of the cruising boat.

In this connection, with a deflector disclosed in U.S. Pat. No. 4,657,513 (entitled "Transom Bracket Water Deflector for Improved Boat Performance") the deflector is formed V-shaped in cross-section to provide a downwardly pointed straight ride extending in the fore-and-aft direction between the boat transom and an outboard propulsion unit. With this prior art arrangement, linear water flow is generated from the V-shaped deflector bottom sec ion and impinges against the outboard propulsion unit, thereby splashing water to produce water spray. Additionally, when the boat turns during its cruising, the V-shaped deflector bottom section produces a wave reaching the propeller, thus lowering propulsion force of the propeller.

Figure 6:
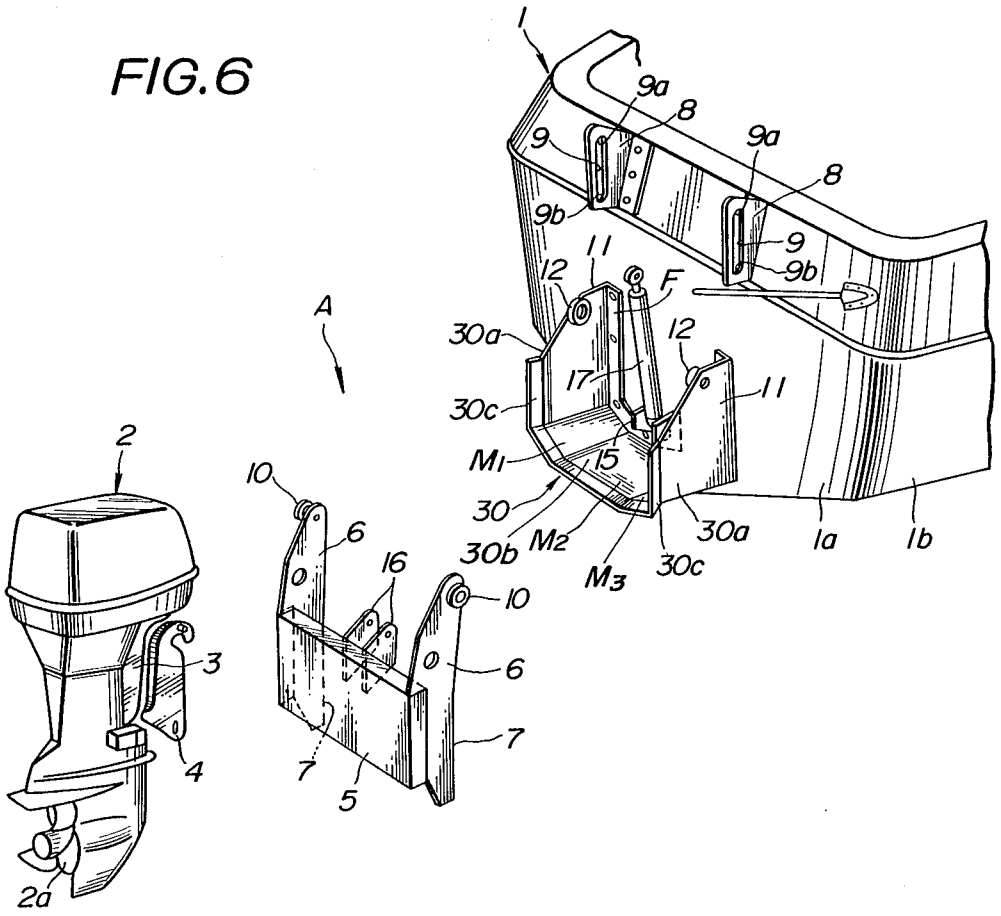
FIG. 6 is an exploded perspective view of a second embodiment of the outboard propulsion unit supporting system according to the present invention.
Figure 7:
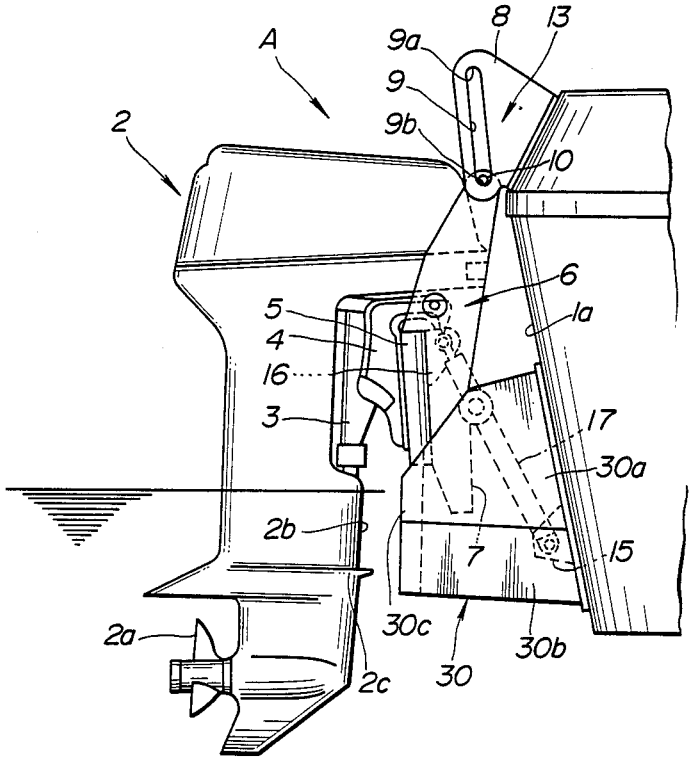
FIG. 7 is a side elevation of the supporting system of FIG. 6.

FIGS. 6 and 7 illustrate a second embodiment of the outboard propulsion unit supporting system A of the present invention, similar to the first embodiment except for the following structure: In this embodiment, a pair of slit brackets 8, 8 are installed at the upper peripheral section of the rear end of the boat 1 and located opposite to each other with respect to the vertical plane containing the boat longitudinal axis. Each slit bracket 8 is formed with a vertically extending slit 9 having upper and lower terminals 9*a*, 9*b*. Thrust receiving or transom brackets 11, 11 are fixedly secured at their flange F to the boat transom 1*a*. The flange F is integral with each thrust receiving bracket 11. Each thrust receiving bracket 11 extends downwardly and rearwardly from the boat transom 1*a* to form the deflector side plate section 30*a*.

As shown, the upper end portion of each side plate section 30*a* is separate from the upper end of the boat transom 1*a*. The lower end portions of the two side plate sections 30*a*, 30*a* are respectively integral with the upper end portions of the first and second side inclined plates $M_1$, $M_3$ of the deflector bottom plate section 30*b*. The deflector 30 is formed with a flange like guide plate section 30*c* which is integral with the rear end portions of the side and bottom plate sections 30*a*, 30*b* and outwardly directed. More specifically, each of the side and bottom plate sections 30*a*, 30*b* is integrally formed at their rear end portion with an outwardly bent guide plate section 30*c*. This guide plate section 30*c* further improves water flow deflection effect.

Each arm bracket 6 is provided at its outer side face with a guide roller 10 to be disposed rotatably within the slit 9 of the slit bracket 8. The guide roller 10 moves between the lower and upper terminals 9*a*, 9*b* in accordance with operation of the tilt cylinder 17. Each arm bracket 6 is formed with a generally vertically extending front edge 7 which is engaged with a thrust roller 12 pivotally attached to the inner side face of the thrust bracket 11.

Figure 8:
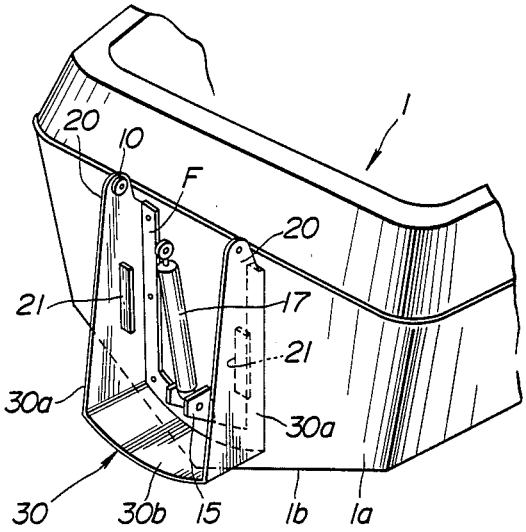
FIG. 8 is perspective view of an essential part of a third embodiment of the outboard propulsion unit supporting system according to the present invention.

FIG. 8 illustrates a third embodiment of the outboard propulsion unit supporting system of the present invention similar to the first embodiment with the exception that the deflector bottom plate section 30*b* of the deflector 30 consists of a downwardly bent or convex plate having an arcuate cross-section.

Figure 9:
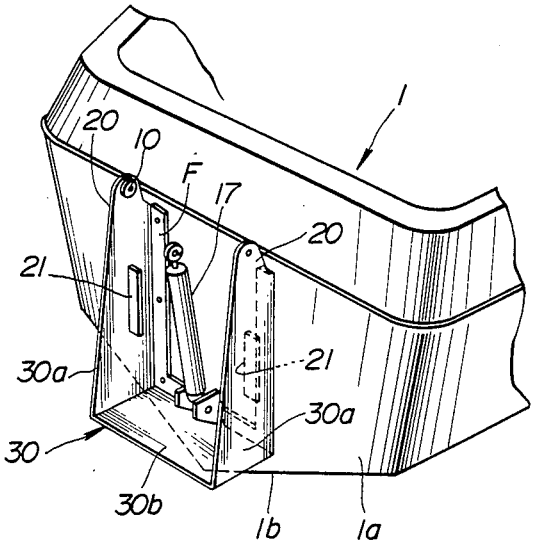
FIG. 9 is a perspective view of an essential part of a fourth embodiment of the outboard propulsion unit supporting system in accordance with the present invention.

FIG. 9 illustrates a fourth embodiment of the outboard propulsion unit supporting system of the present invention similar to the first embodiment except for the shape of the bottom plate section 30*b* of the deflector 30. In this embodiment, the bottom plate section consists of a flat plate arranged perpendicular to the side plate sections 30*a*.

While the present invention has been explained in connection only with the outboard propulsion unit supporting systems of the type wherein the distance between the boat and the propulsion unit does not substantially change even upon vertical movement of the propulsion unit, it will be appreciated that the principle of the present invention may be applied to other outboard propulsion unit supporting systems of the type wherein the distance between a boat and an outboard propulsion unit changes in which the deflector is designed on the basis of the most largest distance therebetween thereby to attain a desired effect, and of the type having only tilting function for the outboard propulsion unit.

What is claimed is:

1. An outboard propulsion unit supporting system for a boat, comprising:

first and second transom brackets secured to a boat transom and positioned spaced from each other to support an outboard propulsion unit;

first and second deflector side plate sections which are respectively integral with said first and second transom brackets and extend downwardly and rearwardly relative to the boat transom; and a deflector bottom plate section connecting said first and second deflector side plate sections, said deflector bottom plate section extending rearwardly relative to the boat transom and positioned between said boat and the outboard propulsion unit, said deflector bottom plate section including a generally flat portion which is generally horizontal relative to the boat and positioned at a central part of the deflector bottom plate section, said flat portion being located below the level of a splash plate of the outboard propulsion unit and extending generally in directions of width and length of the boat;

said first and second deflector side plate sections and said deflector bottom plate section constituting a deflector for rearward water flow from the boat.

2. An outboard propulsion unit supporting system for a boat, comprising:

first and second transom brackets secured to a boat transom and positioned spaced from each other to support an outboard propulsion unit;

first and second deflector side plate sections which are respectively integral with said first and second transom brackets and extend downwardly and rearwardly relative to the boat transom; and a deflector bottom plate section connecting said first and second deflector side plate sections, said deflector bottom plate section extending rearwardly relative to the boat transom and positioned between said boat and the outboard propulsion unit, said deflector bottom plate section including a generally flat portion which is generally horizontal relative to the boat and positioned at a central part of said deflector bottom plate section, said flat portion being located below the level of a splash plate of the outboard propulsion unit and extending generally in directions of width and length of the boat, said deflector bottom plate section flat portion having a lower-surface which is generally flat and smooth;

said first and second deflector side plate sections and said deflector bottom plate section constituting a deflector for rearward water flow from the boat.

3. An outboard propulsion unit supporting system as claimed in claim 2, wherein said first transom bracket and deflector side plate section form a first elongate plate extending generally vertically with respect to the boat transom, and said second transom bracket and deflector side plate section form a second elongate plate extending generally vertically with respect to the boat transom.

4. An outboard propulsion unit supporting system as claimed in claim 2, wherein said first and second deflector side plate sections are opposite to each other with respect to a vertical plane containing a longitudinal axis of the boat, and parallel with the vertical plane.

5. An outboard propulsion unit supporting system as claimed in claim 4, wherein said deflector bottom plate section extends generally parallel with the boat longitudinal axis.

6. An outboard propulsion unit supporting system as claimed in claim 2, further comprising means for maintaining tight contact between the boat transom and said deflector to prevent water flow from entering through between the boat transom and said deflector.

7. An outboard propulsion unit supporting system as claimed in claim 6, wherein said tight contact maintaining means includes a first flange integral with said first deflector side plate, a second flange integral with said second deflector side plate, and a third flange integral with said deflector bottom plate section, said first, second and third flanges being integral with each other and fixedly secured to the boat transom.

8. An outboard propulsion unit supporting system as claimed in claim 2, wherein each of said first and second deflector side plate sections has a lower end portion located near a lower-most part of the boat transom, wherein said deflector bottom plate section is integrally connected at its opposite side portions with the lower end portions of said first and second deflector side plate sections.

9. An outboard propulsion unit supporting system as claimed in claim 8, wherein the lower end portions of said first and second side plate sections are located on the same level with respect to the boat and lie on a first plane generally parallel with a horizontal plane containing longitudinal axis of the boat.

10. An outboard propulsion unit supporting system as claimed in claim 9, wherein said deflector bottom plate section includes first, second and third plates, said first plate and second plates being inclined with respect to said first plane and integrally connected respectively to said first and second deflector side plate sections, said third plate being located between and integrally connected with said first and second plates, said third plate lying on a second plane which is generally parallel with said first plane and positioned below said first plane.

11. An outboard propulsion unit supporting system as claimed in claim 9, wherein said deflector bottom plate section includes a flat plate integral with said first and second deflector side plate sections and generally parallel with said horizontal plane.

12. An outboard propulsion unit supporting system as claimed in claim 2, further comprising a tilt cylinder disposed between said first and second deflector side plate sections and having a lower end section secured to the boat transom and a upper end section connected to the outboard propulsion unit.

13. An outboard propulsion unit supporting system as claimed in claim 2, wherein said deflector bottom plate section lower-most portion includes a generally flat plate which is generally perpendicular to a vertical plane containing a longitudinal axis of the boat.

14. An outboard propulsion unit supporting system as claimed in claim 2, wherein the extension of a vertical plane containing the longitudinal axis of the boat passes through said deflector bottom plate section flat portion.

15. An outboard propulsion unit supporting system for a boat, comprising:

first and second transom brackets secured to a boat transom and positioned spaced from each other to support an outboard propulsion unit;

first and second deflector side plate sections which are respectively integral with said first and second transom brackets and extend downwardly and rearwardly relative to the boat transoms; and a deflector bottom plate section connecting said first and second deflector side plate sections, said deflector bottom plate section extending rearwardly relative to the boat transom and positioned between said boat and the outboard propulsion unit, said deflector bottom plate section including a generally flat portion which is generally horizontal relative to the boat and positioned at a central part of the deflector bottom plate section, said flat portion being located below the level of a splash plate of the outboard propulsion unit and extending generally in directions of width and length of the boat, the width of said generally flat portion in the direction of width of the boat being larger than the thickness of a bottom plate of the outboard propulsion unit;

said first and second deflector side plate sections and said deflector bottom plate section constituting means for deflecting rearward water flow from the boat and for preventing water spray due to water striking the front edge of the propulsion unit.

16. An outboard propulsion unit supporting system for a boat, comprising:

first supporting means by which an outboard propulsion unit is supported on the boat, said first supporting means including means defining a slit extending generally vertically and having upper and lower terminals, and a movable member engaged in said slit, wherein one of said slit and said movable member is vertically movable with respect to the other;

second supporting means by which the propulsion unit is supported to the boat, said second supporting means including means forming a guide rail extending generally vertically, and a support member detachably contactable with said guide rail, wherein one of said guide rail and said support member is movable with respect to the other, and further wherein said slit and said support member are in a fixed relationship relative to one another, and wherein said movable member and said guide rail are in a fixed relationship relative to one another;

a hydraulic cylinder whose whole length is changeable to move said propulsion unit relative to the boat, said hydraulic cylinder having a first end section pivotally connected to the side of the boat and a second end section pivotally connected to the side of the propulsion unit, said second end section being positioned upper and rear relative to said first end section;

first and second transom brackets secured to a boat transom and positioned spaced from each other to support the outboard propulsion unit;

first and second deflector side plate sections which are respectively integral with first and second transom brackets and extend downwardly and rearwardly relative to the boat transom; and a deflector bottom plate section connecting said first and second deflector side plate sections, said deflector bottom plate section extending rearwardly relative to the boat transom and positioned between said boat and the outboard propulsion unit, said deflector bottom plate section including a generally flat portion which is generally horizontal relative to the boat and positioned at a central part of the deflector bottom plate section, said flat portion being located below the level of a splash plate of the outboard propulsion unit and extending generally in directions of width and length of the boat;

said first and second deflector side plate sections and said deflector bottom plate section constituting means for deflecting rearward water flow from the boat and for preventing water spray due to water striking the front edge of the propulsion unit.

17. An outboard propulsion unit supporting system as claimed in claim 1, wherein said generally flat portion of said deflector bottom plate section has a lower surface located between the level of said splash plate and the level of a cavitation plate formed on a bottom plate of said outboard propulsion unit.

18. An outboard propulsion unit supporting system as claimed in claim 15, wherein the length of said generally flat portion in the direction of length of the boat is sufficient to prevent water from striking the front edge of the propulsion unit above said splash plate.

19. An outboard propulsion unit supporting system for a boat comprising:

first and second transom brackets secured to a boat transom and positioned spaced from each other to support an outboard propulsion unit;

first and second deflector side plate sections which are respectively integral with said first and second transom brackets and extend downwardly and rearwardly relative to the boat transom; and a deflector bottom plate section connecting said first and second deflector side plate sections, said deflector bottom plate section extending rearwardly relative to the boat transom and positioned between said boat and the outboard propulsion unit, said deflector bottom plate section including a generally curved portion which is generally curved downward relative to the plane of the boat and positioned at a central part of the deflector bottom plate section, said curved portion being located below the level of a splash plate of the outboard propulsion unit and extending generally in directions of width and length of the boat;

said first and second deflector side plate sections and said deflector bottom plate section constituting a deflector for rearward water flow from the boat.

* * * * *